US005248859A

United States Patent [19]

Borla

[11] Patent Number: 5,248,859

[45] Date of Patent: Sep. 28, 1993

[54] COLLECTOR/MUFFLER/CATALYTIC CONVERTER EXHAUST SYSTEMS FOR EVACUATING INTERNAL COMBUSTION ENGINE CYLINDERS

[76] Inventor: Alexander Borla, 5190 E. Kings Grove Dr., Somis, Calif. 93066

[21] Appl. No.: 962,941

[22] Filed: Oct. 19, 1992

Related U.S. Application Data

[63] Continuation-in-part of Ser. No. 674,082, Mar. 25, 1991, Pat. No. 5,198,625.

[51] Int. Cl.[5] ..... F01N 7/00

[52] U.S. Cl. ..... 181/238; 181/240; 181/251; 181/252; 181/257; 181/258; 181/268; 181/282

[58] Field of Search ..... 181/238, 239, 240, 243, 181/252, 255, 256, 257, 258, 267, 268, 269, 272, 273, 275, 282

[56] References Cited

U.S. PATENT DOCUMENTS

| | | | |
|---|---|---|---|
| 2,059,487 | 11/1936 | Peik | 181/252 |
| 2,113,828 | 4/1938 | Compo | 181/266 |
| 2,188,444 | 1/1940 | Sauer | 181/249 |
| 2,292,340 | 8/1942 | McCurdy | 181/250 |
| 2,373,231 | 4/1945 | Demuth | 181/264 |
| 2,613,758 | 10/1952 | Cullum | 181/258 |
| 2,825,202 | 3/1958 | Bertin et al. | 181/233 |
| 2,841,951 | 7/1958 | Whitcomb | 181/249 |
| 2,958,388 | 11/1958 | Paulsen | 181/252 |
| 2,990,906 | 7/1961 | Audette | 181/251 |
| 2,998,860 | 9/1961 | Everett . | |
| 3,075,609 | 1/1963 | Potter | 181/251 |
| 3,114,431 | 12/1963 | Sanders | 181/251 |
| 3,159,237 | 12/1964 | Thomas | 181/252 |
| 3,159,239 | 12/1964 | Andrews | 181/247 |
| 3,221,836 | 12/1965 | Kleinig | 181/252 |
| 3,233,698 | 2/1966 | Powers | 181/249 |
| 3,396,813 | 8/1968 | Hall | 181/249 |
| 3,412,825 | 11/1968 | Hall | 181/249 |
| 3,453,824 | 7/1969 | Biesecker | 181/238 |

(List continued on next page.)

FOREIGN PATENT DOCUMENTS

| | | |
|---|---|---|
| 1283147 | 6/1962 | France . |
| 41-723 | 5/1963 | Japan . |
| 502124 | 4/1976 | U.S.S.R. . |

*Primary Examiner*—Michael L. Gellner
*Assistant Examiner*—Khanh Dang
*Attorney, Agent, or Firm*—Barnes, Kisselle, Raisch, Choate, Whittemore & Hulbert

[57] ABSTRACT

An exhaust collector for use with an internal combustion engine of the type having a plurality of generally nested exhaust tubes for individually receiving exhaust gases from separate associated engine exhaust ports. The collector is frustoconically shaped and has an open upstream end sealingly engaged with the downstream ends of the exhaust tubes to receive exhaust gases directly therefrom. The collector is oriented with its generally conical shape convergent in the downstream direction, and includes an internal cone shaped stem piece oriented with its longitudinal axis coaxial of the collector. A base portion of the stem piece is nested between and extends from the downstream ends of the exhaust tubes, and an apex end of the stem piece is generally aligned with the collector downstream end. The collector interior wall defines a smooth cylindrical surface when taken in radial cross section at any position along generally the entire length of the axis of the collector downstream of the tube exit ends. Preferably, the upstream end of the collector portion is formed to conform with and securely join to the array of nested exhaust tubes.

A muffler/collector combination has an outer muffler casing encircling the collector portion and encasing the same with upstream and downstream end caps. An additional embodiment provides for at least one catalytic exhaust converter positioned and arranged within a corresponding exhaust tube upstream of the collector, in combination with either the collector or the muffler collector combination. Sound absorbing material may be disposed in an interior casing space defined between the inner surface of the outer casing and the outer surface of the nested exhaust tubes and the collector.

31 Claims, 4 Drawing Sheets

U.S. PATENT DOCUMENTS

| | | | |
|---|---|---|---|
| 3,462,947 | 8/1969 | Nowak | 181/275 |
| 3,470,690 | 10/1969 | Thompson | 181/248 |
| 3,491,534 | 1/1970 | Garner | 181/238 |
| 3,507,301 | 4/1970 | Larson | 181/238 |
| 3,516,247 | 6/1970 | Knox, Jr. | 181/240 |
| 3,670,844 | 6/1972 | Penfold, Jr. | 181/228 |
| 3,808,807 | 5/1974 | Lanpheer | 181/245 |
| 3,813,880 | 6/1974 | Reid et al. | 181/235 |
| 3,863,733 | 2/1975 | Raudman, Jr. et al. | 181/252 |
| 4,106,289 | 8/1978 | von Schnurbein et al. | 181/240 |
| 4,108,276 | 8/1978 | Hall et al. | 181/256 |
| 4,133,479 | 1/1979 | Musitano et al. | 181/264 X |
| 4,153,136 | 5/1979 | Ferralli | 181/252 |
| 4,203,502 | 5/1980 | Strader | 181/238 |
| 4,206,600 | 6/1980 | Feuling | 60/312 |
| 4,226,298 | 10/1980 | Bancel et al. | 181/252 X |
| 4,234,054 | 11/1980 | Chapin | 181/252 |
| 4,252,212 | 2/1981 | Meier | 181/248 |
| 4,263,982 | 4/1981 | Feuling | 181/256 |
| 4,289,169 | 9/1981 | Banholzer | 138/117 |
| 4,348,862 | 9/1982 | Fujikawa et al. | 60/314 |
| 4,356,886 | 11/1982 | Daude et al. | 181/250 |
| 4,415,059 | 11/1983 | Hayashi | 181/250 |
| 4,422,519 | 12/1983 | Nomura et al. | 181/238 X |
| 4,456,091 | 6/1984 | Blanchot | 181/282 |
| 4,482,096 | 6/1984 | Fujitsubo | 181/252 |
| 4,484,659 | 11/1984 | Buchwalder | 181/266 |
| 4,621,494 | 11/1986 | Fujita | 60/313 |
| 4,712,644 | 12/1987 | Sun | 181/251 |
| 4,796,426 | 1/1989 | Feuling | 60/313 |
| 4,848,214 | 5/1989 | Feuling | 181/249 |
| 4,866,931 | 9/1989 | Hansen | 60/274 |
| 5,033,581 | 7/1991 | Feuling | 181/257 |
| 5,044,159 | 9/1991 | Landfahrer et al. | 60/314 |
| 5,050,378 | 9/1991 | Clemmens | 60/313 |
| 5,083,427 | 1/1992 | Anderson | 60/274 |
| 5,083,429 | 1/1992 | Veres et al. | 60/325 |
| 5,094,072 | 3/1992 | Ampferer et al. | 60/290 |
| 5,094,074 | 3/1992 | Nishizawa et al. | 60/300 |
| 5,094,821 | 3/1992 | Hitachi et al. | 60/301 X |

COLLECTOR/MUFFLER/CATALYTIC CONVERTER EXHAUST SYSTEMS FOR EVACUATING INTERNAL COMBUSTION ENGINE CYLINDERS

This application is a continuation-in-part of copending application Ser. No. 07/674,082, now U.S. Pat. No. 5,198,625, filed Mar. 25, 1991 which is incorporated herein by reference.

BACKGROUND OF THE INVENTION

This invention relates in general to evacuating and silencing high velocity air or gas exhaust flow to atmosphere or the like, and is particularly directed to collector/muffler/catalytic converter exhaust system configurations for use with internal combustion engines and the like.

The problem of evacuating and muffling the exhaust gases from internal combustion engine cylinders is well known. Many types of exhaust systems utilizing combinations of headers, collectors and mufflers as well as other noise reducing devices have been developed to address this problem. One type of exhaust system generally referred to as a collector combines and directs exhaust gases from separate exhaust tubes into a common downstream exhaust pipe. To effect noise reduction of the exhaust gases, mufflers are used in combination with these collectors, being attached downstream of the outlet pipe of the collector. Additionally, catalytic converters are attached to the exhaust system. These collector, muffler and catalytic converter systems are advantageous in that they provide a joining of exhaust gases from the plurality of engine exhaust tubes to produce a single fairly uniform stream of exhaust gases which is then passed through the catalytic converter and muffler, but they are not very effective at minimizing the complexity of the exhaust system as they require many separate components and take up substantial space beneath a vehicle underbody. They also create a great deal of back pressure, and do not lend themselves to exhaust tuning.

An object of the present invention is to provide a collector/muffler/catalytic converter configuration that provides for enhanced evacuating of the internal combustion engine cylinders while providing opportunities to incorporate muffler and noise reduction features integrally with a collector, as well as to incorporate catalytic converter features therein.

Another object is to provide a collector/muffler/catalytic converter configuration which is economical in construction, reliable in operation, rugged and able to withstand automotive racing use for extended periods, and which has a compact configuration compatible with under vehicle mounting.

The foregoing and other objects, features and advantages will become apparent to those skilled in the art upon reading the following detailed description of preferred embodiments, which follows, in conjunction with a review of the appended drawings (which are to scale unless otherwise noted) wherein.

Figure 11:
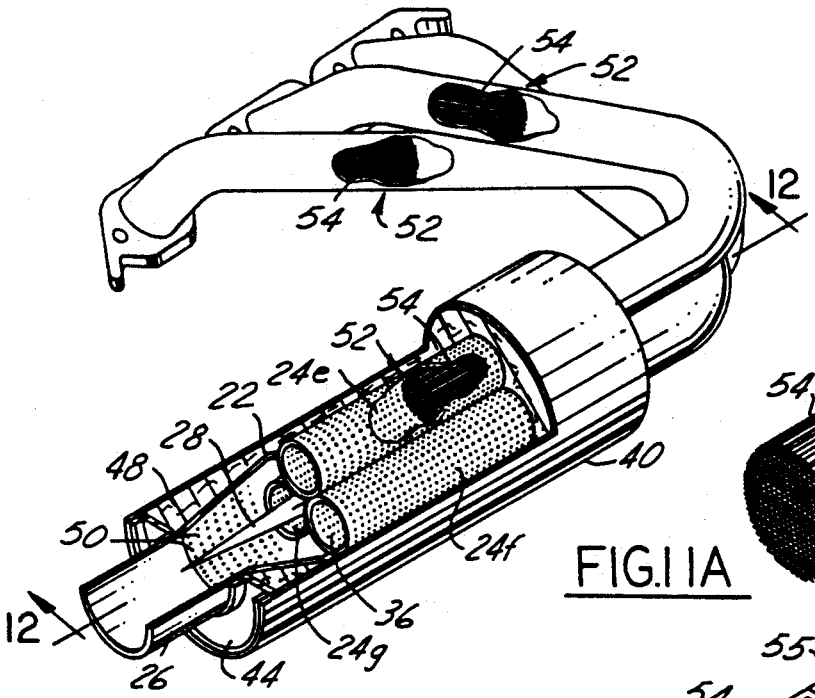
FIG. 11 is a cutaway perspective view of a third working exemplary but presently preferred embodiment of the invention.
Figure 11A:
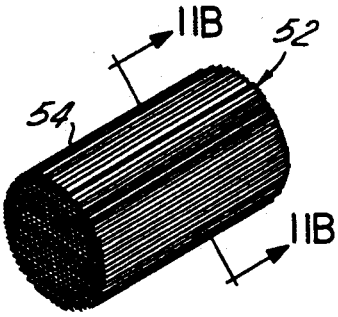
Figure 11B:
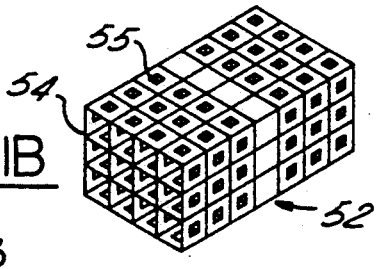

FIG. 11*a* is a perspective view of a catalytic converter honeycomb core containing catalytic material as incorporated in FIG. 11;

FIG. 11*b* is an enlarged perspective view of a portion of honeycomb core material taken about section A—A of the honeycomb core in FIG. 11*a;*

Figure 12:
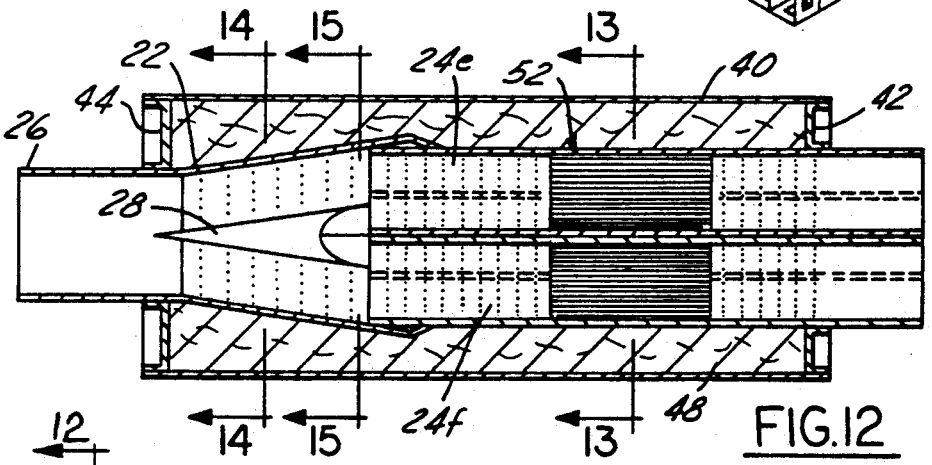
Figure 13:
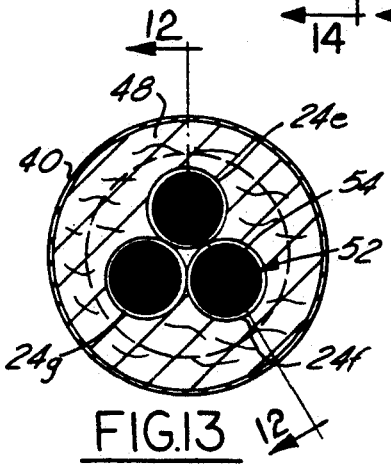
Figure 14:
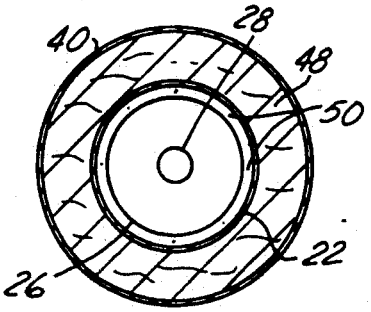
Figure 15:
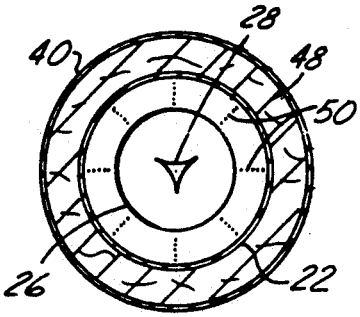
Figure 16:
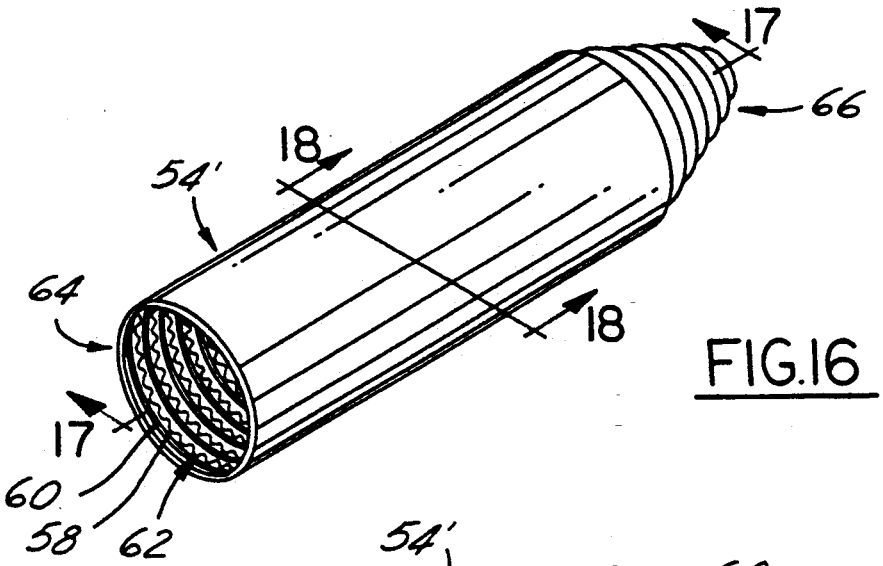

FIG. 12 is a cross-sectional view taken along line 12—12 of FIG. 11;

FIG. 13 is a cross-sectional view taken along line 13—13 of FIG. 12;

FIG. 14 is a cross-sectional view taken along line 14—14 of FIG. 12;

FIG. 15 is a cross-sectional view taken along line 15—15 of FIG. 12;

FIG. 16 is a perspective view of a second working exemplary embodiment of the catalytic converter honeycomb core as shown in FIG. 11*a;*

Figure 17:
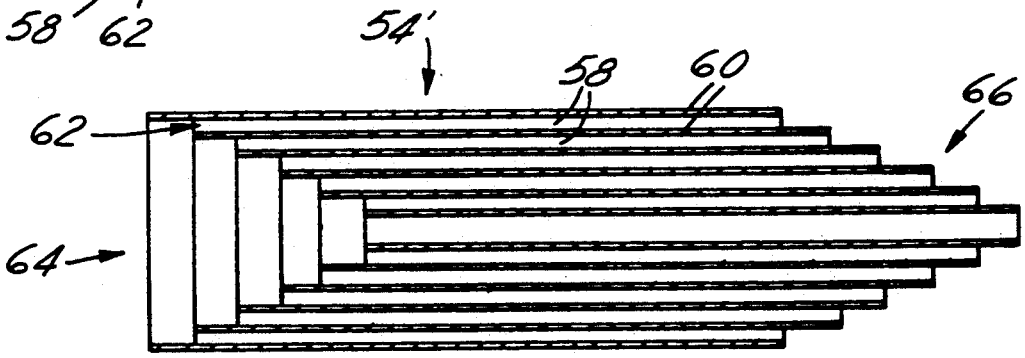
Figure 18:
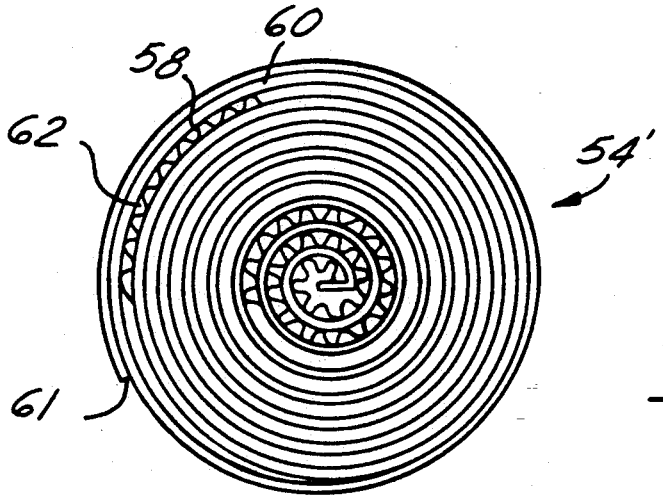
Figure 19:
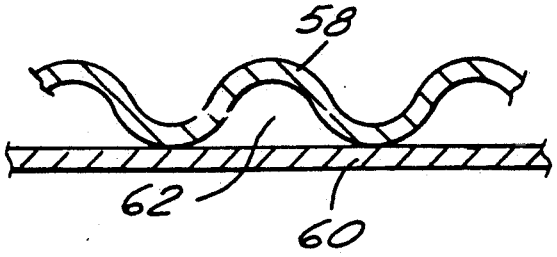

FIG. 17 is a cross-sectional view taken along line 17—17 of FIG. 16;

FIG. 18 is a cross-sectional view taken along line 18—18 of FIG. 16,

FIG. 19 is an unrolled segment of catalytic converter honeycomb core structure as utilized to construct the catalytic converter core of FIG. 16, and as taken in section 18—18 of FIG. 16 and unrolled.

DETAILED DESCRIPTION

Figure 1:
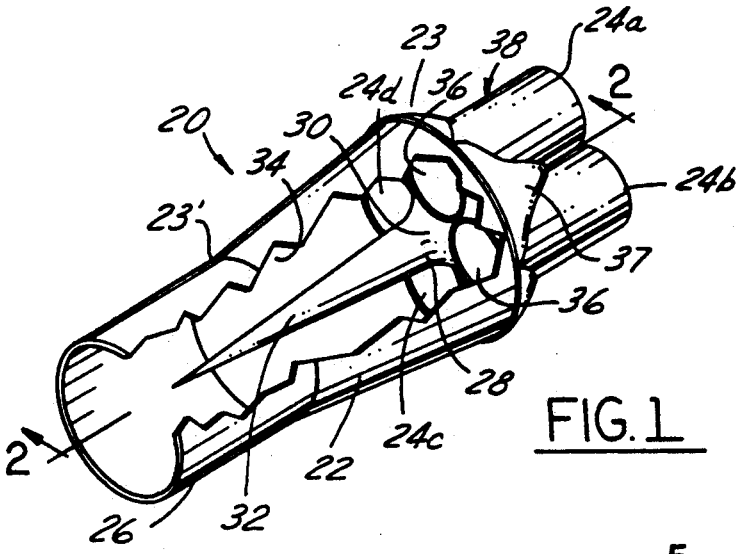
FIG. 1 is a cutaway perspective view of one working exemplary embodiment of the invention.

FIG. 1 illustrates one exemplary embodiment of a collector assembly 20 of the invention which includes a generally frustoconically shaped collector 22 with an upstream inlet end 23 and a downstream outlet end 23', and orientated with its generally conical shape convergent in the downstream direction. Secured to and telescoped within the upstream end 23 of said collector 22 is a plurality of exhaust tubes 24 (four tubes 24*a*, 24*b*, 24*c* and 24*d* being illustrated) each communicating and sealingly engaging with the upstream end of said collector 22, as well as preferably being generally configured in a nested generally parallel array. The upstream ends of said exhaust tubes 24 (not illustrated) are adapted to receive exhaust gases from separate associated engine exhaust ports in a known conventional manner. The convergent end 23' of collector 22 is positioned and arranged downstream (relative to the direction of exhaust gas flow) of the upstream and divergent end of said collector 22. An outlet duct 26 is secured to the end 23' of collector 22. A cone shaped stem piece 28, oriented with its longitudinal axis substantially parallel to the axis of collector 22 and located coaxially and internally of collector 22, is positioned with its base portion 30 nested between and extending from the downstream ends of exhaust tubes 24. The apex end portion 32 of stem 28 is positioned on the axis of collector 22 generally aligned with the center of the downstream end of collector 22. Interior wall 34 of collector 22 defines a smooth cylindrical surface when taken in radial cross section at any position along generally the entire length of the axis of collector 22 downstream of the exit ends 36 of tubes 24.

An assembly of exhaust tubes 24 is preferably made up of at least three generally laterally nested tubes 24, and as seen, for example, in the embodiment of FIG. 1, is made up of four tubes 24*a*, 24*b*, 24*c* and 24*d* supported at their downstream ends 36 by the upstream end of collector 22. This tube assembly 38 is arranged from tubes 24 preferably of equal diameter disposed in a packed or nested array so as to extend preferably parallel to one another with mutually adjacent tubes disposed in lateral contact. Alternatively, the tubes can be disposed at least about their downstream ends so as to be slightly convergent in the direction of downstream flow, i.e., with their respective axes at a slight angle relative to one another, preferably on the order of about a 7° included angle and at about a 3.5° angle relative to the longitudinal axis of the collector as the tubes converge into the upstream end of the collector. To facilitate assembly, the tubes are welded together at their ends to form assembly 38 as seen in FIG. 1, as well as being joined to the upstream end of collector 22 by welding together tubes 24 to collector 22.

Figure 2:
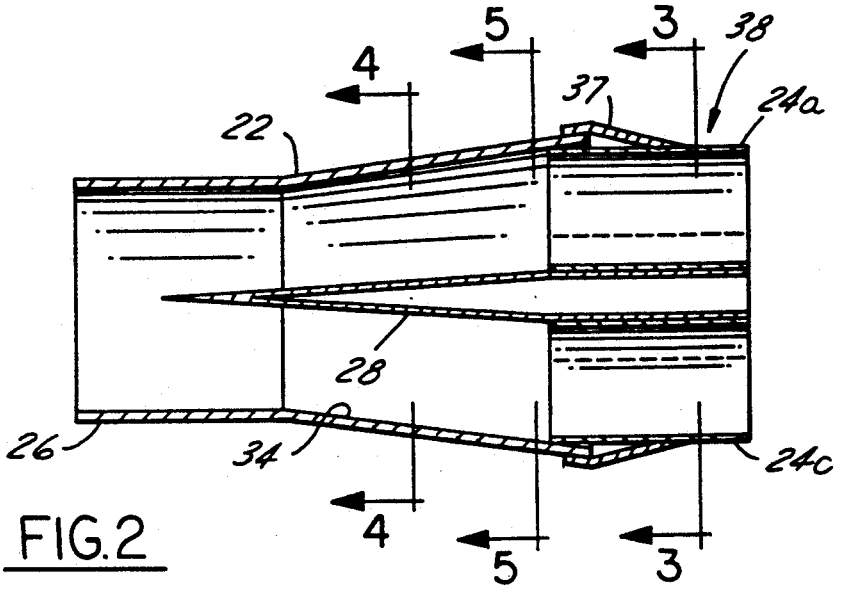
FIG. 2 is a cross-sectional view taken along line 2—2 of FIG. 1.
Figure 3:
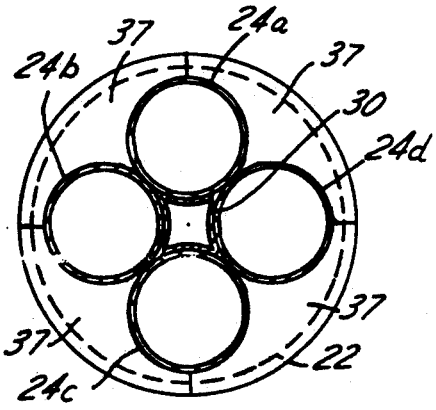
FIG. 3 is a cross-sectional view taken along line 3—3 of FIG. 2.
Figure 4:
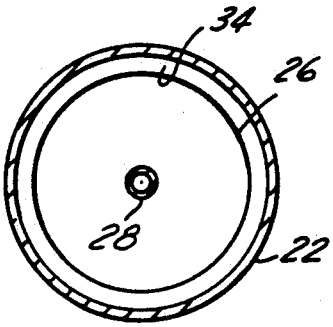
FIG. 4 is a cross-sectional view taken along line 4—4 of FIG. 2.
Figure 5:
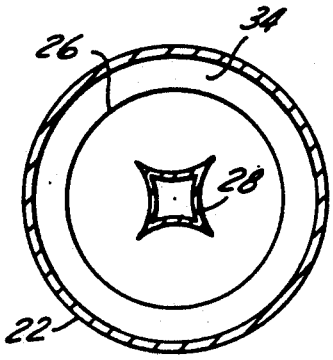
FIG. 5 is a cross-sectional view taken along line 5—5 of FIG. 2.

FIGS. 2 and 3 further show the nested array of tubes 24 found in tube assembly 38. Additionally, the internal and coaxial positioning of cone shaped stem piece 28 inside collector 22 is shown in FIG. 2 and FIG. 4, whereby the interior surface 34 of collector 22 and the exterior surface of stem piece 28 are arranged with their generally parallel surfaces aligned with their generally conical shape convergent in the downstream direction of exhaust gas flow. FIG. 5 shows a transition zone between its base portion 30, as nested between the exhaust tubes and forming a polysided concave transitional section, and extending downstream to form the conically shaped apex portion 32 of stem piece 28 of circular cross section as depicted in FIG. 4. The leading edge of base portion 30 thus is formed complemental to the trailing edge surfaces of tubes 24 facing one another and which define a center space in the tube array. The concave sides of base portion 30 diminish and flare into the conical smooth circular wall portion 32 a short distance downstream of the base portion leading edge. Preferably, the nested tube assembly 38 is supported at the downstream end 36 of said tubes 24 by the upstream end of said collector 22 being crimped thereto and then being welded, as set forth in more detail in parent copending application Ser. No. 07/674,082 filed Mar. 25, 1991 and incorporated herein by reference. In an alternative embodiment of the collector as used in the FIG. 1, 6 and 11 configurations, the upstream end of collector 22 is not crimped and the resultant circumferentially spaced gaps are sealed to the tube assembly 38 by use of a preferably 14° (included angle) reverse cone or a flat end plate (not shown). These gaps may also be sealed by an array of gusset pieces 37 constructed and arranged by welding fitted pieces of metal to collector 22 and associated tubes 24 to cover the gap spaces.

Referring to FIGS. 6–10, an embodiment of a muffler 39 containing collector 20 is shown incorporating the collector of FIG. 1, whereby entire collector assembly 20, including collector 22 and tube assembly 38, are contained within an outer muffler casing 40. Casing 40 has an inlet end 41 positioned upstream of collector assembly 20 and an outlet end 41' positioned downstream of said collector assembly 20, thereby encasing collector assembly 20 and the downstream ends of tube assembly 38 of the nested array of exhaust tubes 24. An upstream end cap 42 is positioned and arranged to abut in sealing engagement with the upstream end of casing 40 (FIG. 7), and a downstream end cap 44 is positioned and arranged to abut in sealing engagement with the downstream end of said outer casing 40. The tube assembly 38, comprised of the plurality of nested exhaust tubes 24, pass in sealing engagement through upstream end cap 42, and thence internally through casing 40 and terminate with downstream tube ends 36 exhausting into upstream end of collector 22. The cylindrical conduit 26 communicates with the downstream end of collector 22 and passes in sealing engagement through downstream end cap 44 to thereby form a muffler apparatus in combination with collector assembly 20 internally contained within casing 40.

Figure 6:
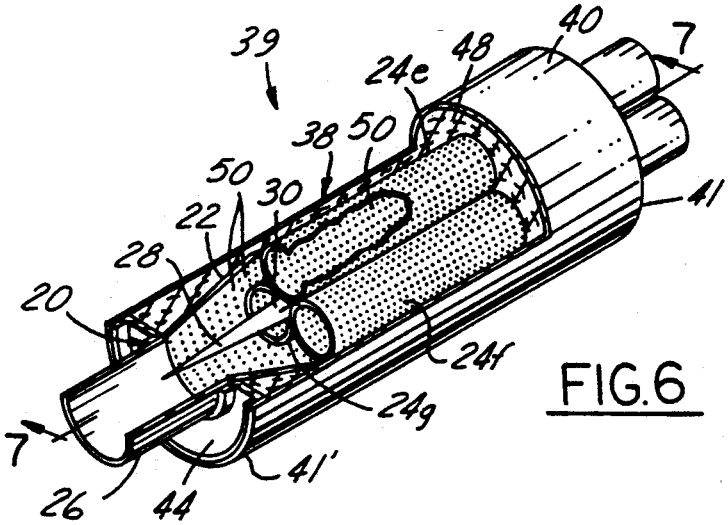
FIG. 6 is a cutaway perspective view of a second working exemplary embodiment of the invention.
Figure 7:
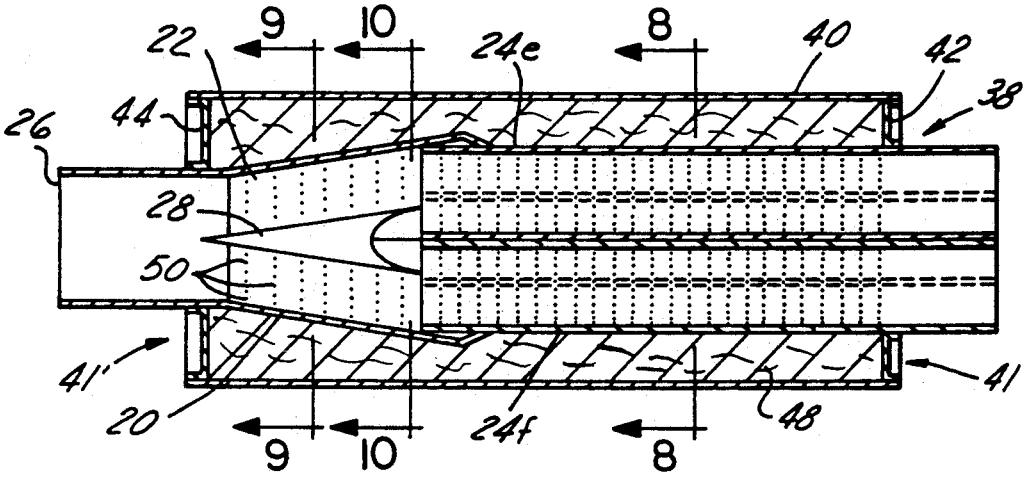
FIG. 7 is a cross-sectional view taken along line 7—7 of FIG. 6.
Figure 8:
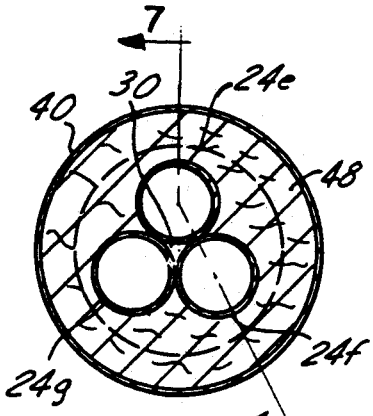
FIG. 8 is a cross-sectional view taken along line 8—8 of FIG. 7.
Figure 9:
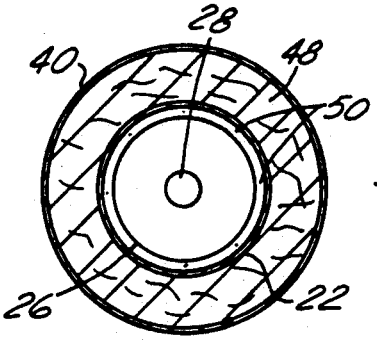
FIG. 9 is a cross-sectional view taken along line 9—9 of FIG. 7.
Figure 10:
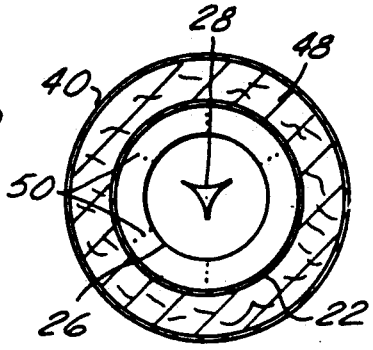
FIG. 10 is a cross-sectional view taken along line 10—10 of FIG. 7.

As seen in FIGS. 7–10, sound absorbing material 48 is preferably disposed in the interior casing space defined radially between tube assembly 38, collector 22 and outer casing 40, preferably filling the entire length of this space between upstream end cap 42 and downstream end cap 44. Tube assembly 38 as seen in the embodiment of FIG. 6 is composed of three tubes 24*e*, 24*f* and 24*g* of equal diameter disposed in a packed or nested array so as to extend generally parallel to one another with mutually adjacent tubes in lateral contact at least at their downstream ends. As in the embodiment of FIG. 1, the tubes are welded together at their downstream ends as well as being welded to the upstream end 23 of collector 22 where the collector is brought into crimped proximity to the tubes 24. Preferably, the tube assembly 38 as shown in FIGS. 6–8 is comprised of tubes 24*e*, 24*f* and 24*g* each having perforations 50. Additionally, collector 22 preferably has perforations. Holes or perforations 50 provide transmission of reflected high frequency components of noise through tubes 24 and collector 22 and into the sound attenuating material 48. Additionally, holes or perforations 50 provide direct and indirect communication between the tubes and collector, allowing the exhaust gases to flow directly from one tube to another, and indirectly from the tube assembly 38 through the perforated holes 50 into the sound attenuating material 48 in which the noise is dissipated and back into the same or different tubes, or into collector 22 through holes 50. The arrangement and configuration of conical stem piece 28 and collector 22 in the embodiment shown in FIG. 6 is identical to that described in the embodiment shown in FIG. 1, except that three tubes 24*e*, 24*f* and 24*g* are joined into a tube assembly 38 rather than four. The coaxial arrangement between stem piece 28 and said collector 22 can be seen in FIGS. 9 and 10. In a first alternative embodiment (not shown), the stem piece can be pyramidally shaped, constructed and arranged from flat, concave or convex members. In a second alternative embodiment (not shown), the stem piece is eliminated altogether.

FIGS. 11–15 illustrate a further embodiment, whereby the features of the embodiment shown in FIG. 6 are further enhanced with the addition of at least one catalytic exhaust converter 52 which consists of a known carrier honeycomb core material 54 (as shown in FIGS. 11A and 11B) containing suitable catalytic material (not shown) and positioned and arranged within at least one of the tubes 24e, 24f and 24g, thereby creating separate and distinct catalytic converters 52 within each of these tubes. Holes 55 are formed in the honeycomb core material to provide for lateral dispersion of exhaust gases and increased catalyst surface area. Suitable construction methods include rolling a corrugated metal sheet with preformed holes to form a honeycomb core, or die forming a ceramic honeycomb with holes. Preferably, the holes are 0.10 inches in diameter, creating 0.20 $in^2$ of surface area. Preferably, catalytic converters 52 are disposed and contained within outer casing 40, casing 40 thereby insulating and shielding from ambient heat generated by each of the catalytic converters. Additionally, or alternatively, as shown in FIG. 11, at least one catalytic exhaust converter 52 can be positioned and arranged within one of the tubes 24e, 24f and 24g upstream of the outer casing 40. As in the alternative embodiments of the FIGS. 7–10 configuration, the stem piece can be pyramidal, or can be eliminated altogether.

In the operation of the embodiment of FIGS. 1–5, a compact vacuum wave collector assembly 20 is provided for a fluid flow, such as the flow of exhaust gases from the plurality of exhaust tubes 24 leaving an internal combustion engine. In the embodiment of FIGS. 6–10 this function is combined with a muffler configuration comprising a casing 40 with end caps 42, 44. In the embodiment of FIGS. 11–15, the further cooperative function of individual catalytic converters 52 internal to the collector/muffler configuration is added to further enhance operation. The collector assembly 20 effectively evacuates the internal combustion engine cylinders by inducing vacuum and pressure waves within each of the exhaust tubes 24 emanating from the internal combustion engine cylinders. More particularly, it is believed the engine exhaust contains considerable energy, some of it in the form of inertia flow, heat and pressures. The energy in question is the energy in a sound wave which leaves the cylinder as a strong, high pressure wave when a particular exhaust valve opens. It travels rapidly through the exhaust pipes to the vacuum wave collector where it converges and echoes back toward the cylinder ports. It is believed the return wave comprises a very strong vacuum. This strong vacuum helps pull in a large charge of air and fuel during the valve overlap. The structure of the collector assembly 20 permits a substantially unimpeded lateral, helical and axial expansion and dispersion of the pressure pulse as it leaves an individual exhaust tube 24 from the internal combustion engine cylinder. The addition of the muffler configuration 39 containing the collector assembly 20 provides the combined functions of a muffler and collector within one casing 40, thereby allowing placement of the assembly in closer proximity to a vehicle center of gravity. Additionally, incorporation of catalytic converters 52 within the tubes 24 of the muffler casing 40 provides for shielding and isolation of heat produced by the catalytic process, and provides faster rise to catalytic operating temperatures.

The development of appropriate structure and geometry of the collector embodiment shown in FIGS. 1–5, as well as when utilized as a component inside the muffler embodiments of FIGS. 6–10 and FIGS. 11–15, was formulated by developing preliminary theories and following up with extensive fabrication and testing of components, as necessitated by the complex functioning and operation of the invention and the lack of complete theoretical understanding of same. The following details set forth more particularly with reference to FIGS. 1–10 the optimum structure and geometry of said collector presently believed to optimize the ability of collector assembly 20 to evacuate internal combustion engine exhaust from each of a plurality of exhaust tubes 24 emanating from individual cylinders, while maintaining little or no back pressure. The collector dimensions are sized to accommodate a 7°±2° decreasing taper of the collector cone inner surface and stem piece outer surface relative to the central axis of the pair. Given the 7°±2° taper, the number and dimension of inlet tubes and the dimensions of an outlet tube, the dimensions of the collector and cone can be sized accordingly. The 7°±2° taper is believed to be the critical dimension which fixes the other component dimensions.

By way of one working example, for a collector combined with a typical three tube exhaust array, such as the subcombination thereof incorporated within the muffler 39 shown in FIGS. 6–10, each tube 24e, 24f and 24g is 1.9 inches in diameter and a single outlet tube 26 of 3.00 inches in diameter, the collector preferably has the following dimensions: the outer collector 22 shall be 5.65 inches in axial length, with an upstream end 23 having a diameter of 4.38 inches and a downstream end 23' having a diameter of 3.00 inches, thereby resulting in a collector cone whose inner surface forms an angle of 7°±2° with the central axis. Likewise, stem piece 28 has an outer frustoconical surface whose central axis length is 5.09 inches and whose outer surface forms an angle of 7°±2° with the central axis, thereby being generally parallel to the inner surface of collector 22. Additionally, the exhaust tubes 24 comprising assembly 38 are preferably circular in cross section, having a typical internal diameter of 1.802 inches. However, again, it is to be understood that the dimensions for a particular application are dependent upon engine displacement and other performance requirements for optimizing the particular engine and exhaust system configuration. In the alternative, the exhaust tubes can have non-circular cross sections.

A collector constructed to the above parameters was installed and tested by Ryan-Falconer at Salinas, Calif., and on Nov. 24, 1991. The test set up comprised connecting this collector to a V6 4.5L General Motors' engine and running it at 500 RPM intervals through a range of 5000–8000 rpms to determine flow characteristics, effects on BHP and torque, and effects on noise attenuation in (dB). From this test, the following results were found: BHP was found to be +10–8000 RPM, and torque was found to be +3–8000 RPM, versus that for an engine with an open header.

In addition to the preceding structure and geometry for the embodiment of FIGS. 6–10, it has also been found that it is preferred to form the upstream end 23 of collector 22 to conform with the assembly 38 of tubes 24, such as by the aforementioned crimping of upstream end 23 onto the exterior of the array of tubes 24, or by casting an appropriate coupling collar or fitting, but in another case fashioning the collector-to-tube ends connection so as not to interrupt the flow of gases in the collector circumferentially around the interior surface of the collector. Such connection means forms a sealing engagement between collector 22 and assembly 38 as when the formed upstream end surface is welded to the assembly 38. Additionally, arrangement of tubes 24 into assembly 38, whereby tubes 24 are engaged to touch and then welded together, provides a structural stiffening, especially when utilized in combination with the welded and crimped upstream end of the collector 22. The combination of the preceding features provides for a collector which evacuates each of tubes 24 and their associated individual engine cylinders while maintaining little or no back pressure, while at the same time achieving these requirements with a minimum of parts, a minimum of weight, and being correspondingly less expensive and simpler while being rugged, durable, of economical manufacture and assembly and requiring little service and maintenance.

The collector/muffler embodiment as shown in FIGS. 6–10 was developed utilizing the preliminary theories and extensive testing of the collector embodiment, as well as further testing specific to the development of the collector/muffler configuration, with additional features further defined and refined through testing as set forth below. The optimal dimensions which derived through extensive testing and which were followed to arrive at a preferred configuration for the collector/muffler 39 of FIGS. 6–10 are the same as those set forth with respect to collector assembly 20 of FIGS. 1–5. Utilization of a four exhaust assembly 38 would require corresponding changes in dimensions, whereby the upstream end of collector 22 and tubes 24 would have the following dimensions: the outer collector 22 shall be 13.25 inches in axial length, with an upstream end 23 having a diameter of 6.30 inches and a downstream end 23' having a diameter of 3.00 inches, thereby resulting in a collector cone whose inner surface forms an angle of $7°\pm2°$ with the central axis. Likewise, stem piece 28 has an outer frustoconical surface whose central axis length is 8.25 inches and whose outer surface forms an angle of $7°\pm2°$ with the central axis, thereby being generally planar to the inner surface of collector 22. Additionally, the exhaust tubes 24 comprising assembly 38 are preferably circular in cross section, having a typical inner diameter of 1.802 inches. The outer casing is preferably constructed to be 15 inches in axial length, with upstream and downstream ends sized in diameter to provide sufficient space between the casing and collector to dispose sufficient sound attenuating material 48 to achieve a desired dB noise level at the outlet of the exhaust system. For a collector with an upstream end diameter of 6.30 inches, a typical outer casing diameter might be 7.00 inches. End caps 42, 44 are constructed and sized to close out the open ends of tube 44. Outlet 26 preferably has an internal diameter of 2.87 inches.

A collector/muffler constructed to the above parameters was installed and tested by Ryan-Falconer at Salinas, Calif. on Nov. 24, 1991. The test set up comprised connecting the collector/muffler to a V-6 4.5L General Motors' engine and running it at 500 RPM intervals through a range of 5000–8000 rpms to determine flow characteristics, effects on BHP and torque, and effects on noise attenuation (dB). From this test, the following results were found: BHP was found to be +9–6500 RPM, torque was found to be +3–6500 RPM, versus that for an open header.

A collector/muffler constructed with the preferred characteristics as detailed in the collector embodiment above, utilizing a formed upstream end on collector 22 and a plurality of tubes 24, welded together, in addition to the foregoing advantages of collector assembly 20, provides when utilized in combination with the outer casing 40 a more compact muffler and collector configuration for utilization underneath a vehicle body. This combination enables a more centrally located placement of the exhaust system near the center of mass for the vehicle within one component. Separate independent structures for containing the collector and muffler are also eliminated, thereby providing a collector/muffler configuration which is simple, economical and reliable, as well as rugged, durable, of economical manufacture and assembly and requiring little service and maintenance.

Incorporation of additional noise attenuation features with this collector/muffler configuration provides further operational improvements to the FIGS. 6–10 embodiment as follows: holes or perforations 50 preferably of 0.10 inches in diameter, creating 0.20 $in^2$ of holes per 1 $in^2$ of surface area, can be included in the downstream ends of tubes 24 as contained within casing 40 as well as in collector 22. These perforations provide communication between tubes 24 and collector 22 and the inside of casing 40 external to said collector and tubes, wherein sound absorbing material 48 may be added therein. Preferably, the sound absorbing material consists of fiberglass, metal wool, composites, glass wool, rockwool or any sound absorbing material, etc, as provided by various manufacturers for use in the environment of an engine exhaust system.

Perforations 50 in the downstream end of the plurality of nested exhaust tubes 24 contained within the outer casing 40, as well as in the collector assembly 20 contained with the casing, causes transmission of high frequency components of noise through the tubes and between the tubes as well as into sound attenuating material 48 which is packed within the casing between the collector 22 and tube assembly 38, in the outer casing 40.

The collector/muffler/catalytic converter embodiment as shown in FIGS. 11–15 was developed utilizing the preliminary theories and extensive testing of the previous two embodiments, as well as further testing specific to the development of the collector/muffler/catalytic converter configuration. The following sets forth more particularly with reference to FIGS. 11–15 the details of the structure and geometry of the catalytic converters 52 added in the FIGS. 11–15 embodiment: the catalytic converter cores 54 are preferably constructed of ceramics, stainless steel metals, alumina or silica, and as currently manufactured by various catalyst manufacturers. The catalyst cores 54 utilize structural support as constructed from Interam by 3M or Inconnel wire mesh or other materials. The catalytic cores are suitably configured to provide for indivdiual catalytic converters 52 within each tube 24, whereby the outer diameters of the catalytic convertors typically are $1.66+-0.05$ inches in diameter. The length of the individual catalytic converters 52 is typically $7''(+-1'')$ inches. The total effective surface area for the catalytic converter cores 54 is typically 2.17 $in^2$ for a given cross sectional area of 2.83 $in^2$ for tube 24.

Alternatively, as shown in FIGS. 16–19, a modified catalytic core embodiment 54' can be constructed for use in convertor 52 by rolling up a flat bonded laminate made up of a corrugated inner sheet 58 and flat outer sheet 60 of material to produce a cylindrically shaped catalytic core. Preferably, the corrugated inner sheet 58 terminates sufficiently short of one end edge 61 of the flat sheet 60 to provide at least one complete wrap of just the outer sheet 60, without the corrugated sheet, about the core. The outside longitudinal end edge of the flat sheet of the laminate as rolled may be suitably, temporarily or permanently affixed to a juxtaposed surface of the rolled material to thereby hold the roll together for handling as a subassembly. Sheet 58 and/or sheet 60 are suitably coated with an thereby serve as a carrier for any suitable exhaust catalytic materials well known in the art. The cores 54' are inserted and fixed as by press fit, crimping or welding within each tube 24 to provide for individual catalytic converters 52 with the associated exhaust tube serving as the outer casing for core 54'. In operation, the hot exhaust gases travel through the axial passageways 62 formed between the corrugated sheet 58 and flat sheets 60 of material as so rolled. Preferably, in forming core 54' a generally convex conical male plug (not show) is utilized to push out and axially progressively displace the coiled laminations slidably of one another so that maximum displacement is at the center of the catalytic core along its central axis to thereby provide a generally cylindrical catalytic core with a concave first end 64 and a correspondingly shaped convex second end 66. Preferably, the concave end is positioned upstream to form an inlet cone for exhaust flow through the catalytic core. Alternatively, the convex end can be oriented at the upstream inlet end. It is presently believed that the aforementioned conical ends provide further channeling and directing of hot exhaust gases and enhanced flow thereof into and through the catalytic core.

A collector/muffler/catalytic converter constructed as in FIGS. 11–15 provides the additional benefit of incorporating three exhaust system components, namely, a catalytic converter, a collector, and a muffler, within one common housing, thereby enabling the combining of three separate exhaust components into one assembly, and providing for central location of the entire mass of these components underneath the vehicle underbody, thereby being more closely positioned to the vehicle center of gravity, as ell as providing the aforementioned advantages of the features carried over from the embodiments of FIGS. 1–5 and FIGS. 6–10. As in the FIGS. 6–10 embodiment, perforations 50 can be included in tubes 24 and collector 22, preferably in the same size and quantity.

An additional feature of the invention is to provide such an array of nested tubes in a twisted or helical bundle as set forth in my aforementioned co-pending U.S. patent application Ser. No. 674,082, filed Mar. 25, 1992, now U.S. Pat. No. 5,198,625, thereby enabling the use of tubes which are longer than straight tubes without thereby increasing the overall length of the collector/muffler configuration while still obtaining substantially unrestricted flow with little or no back pressure.

Further features and variations of the invention can be produced by recombining the previously mentioned features, such as incorporating the individual catalytic converters into each of the nested exhaust tubes entering the collector configuration, thereby combining the catalytic converter and collector components within one functioning apparatus.

It is also to be understood that, although the foregoing description and drawings describe and illustrate in detail successful working embodiments of the present invention, to those skilled in the art to which the present invention relates the present disclosure will suggest many modifications and constructions as well as widely different embodiments and applications without thereby departing from the spirit and scope of the invention. The present invention, therefore, is intended to be limited only by the scope of the appended claims and the applicable prior art.

I claim:

1. A collector for use with an internal combustion engine comprising:

a plurality of generally nested exhaust tubes for individually receiving exhaust gases from separate associated engine exhaust ports and each having an upstream end adapted to receive the exhaust gases from the associated exhaust port, and a downstream end;

a frustoconically shaped collector having an open upstream end positioned downstream from said downstream ends of said exhaust tubes to receive exhaust gases directly therefrom, said collector also having an open downstream end and being oriented with its generally conical shape convergent in the downstream direction between said collector ends;

means for sealingly engaging the downstream ends of said exhaust tubes with the upstream end of said collector;

a cone shaped stem piece oriented with its longitudinal axis substantially parallel to the axis of said outer collector and located coaxially and internally of said collector, said stem piece having a base portion nested between and extending from said downstream ends of said exhaust tubes, and an apex end portion positioned on the axis of said collector generally aligned with said downstream end of said collector;

said collector having an interior wall defining a smooth cylindrical surface when taken in radial cross section at any position along generally the entire length of the axis of said collector downstream of said tube exit ends.

2. The collector as set forth in claim 1 wherein said generally nested exhaust tubes joining said collector are constructed and arranged in touching engagement upstream of said collector, and joined together with fasteners or welds.

3. The collector as set forth in claim 1 wherein the generally nested exhaust tubes are securely joined at their downstream ends with the upstream end of said collector by forming the upstream end of said collector to conform with the array of nested exhaust tubes, and welding said collector to said tubes.

4. The collector as set forth in claim 1 wherein said exhaust tubes are disposed at least about said downstream ends of said exhaust tubes so as to be slightly convergent in the direction of downstream flow with the respective axes of said tube downstream ends being disposed at a slight axial angulation relative to one another as said tubes are received in sealing engagement by the upstream end of said collector.

5. The collector as set forth in claim 4 wherein said axial angulation is preferably on the order of about a 7° included angle between the respective axes of said tube downstream ends and about a 2.5° angle of said respective axes of said tube downstream ends relative to the longitudinal axis of the collector as said tubes converge into the upstream end of said collector.

6. A muffler and collector for use with an internal combustion engine comprising:

a plurality of generally nested exhaust tubes for individually receiving exhaust gases from separate associated engine exhaust ports and each having an upstream end adapted to receive the exhaust gases from the associated exhaust port, and a downstream end;

a collector having a generally frustoconically shaped wall and having an open upstream end positioned downstream from said downstream ends of said exhaust tubes to receive exhaust gases directly therefrom, said collector also having an open downstream end and being oriented with its generally frustoconical wall shape convergent in the downstream direction between said collector ends;

means for sealingly engaging the downstream ends of said exhaust tubes with the upstream end of said collector;

an outer casing having an upstream end positioned upstream of said collector and a downstream end positioned downstream of said collector thereby encasing said collector and at least said downstream ends of said nested array of exhaust tubes;

upstream and downstream casing end closure means positioned and arranged in sealing engagement respectively with said upstream and downstream ends of said outer casing;

said plurality of nested exhaust tubes passing in sealing engagement through said upstream casing end closure means, and thence internally through said outer casing and terminating with said downstream tube ends exhausting into said upstream end of said collector, and conduit means communicating with said downstream end of said collector and passing in sealing engagement through said downstream casing end closure means to thereby form a muffler apparatus in combination with said collector internally contained in said casing.

7. The muffler and collector as set forth in claim 6 which also comprises:

a cone shaped stem piece oriented with its longitudinal axis substantially parallel to the axis of said outer collector and located coaxially and internally of said collector, said stem piece having a base portion nested between and extending from said downstream ends of said exhaust tubes, and an apex end portion positioned on the axis of said collector generally aligned with said downstream end of said collector, said stem piece having an exterior wall defining a smooth cylindrical exterior surface when taken in radial cross section at any position along generally the entire length of the axis of said stem piece.

8. The muffler and collector as set forth in claim 6 which also comprises:

a pyramidally shaped stem piece, constructed and arranged from flat, concave, or convex members, oriented with its longitudinal axis substantially parallel to the axis of said outer collector and located coaxially and internally of said collector, said stem piece having a base portion nested between and extending from said downstream ends of said exhaust tubes, and an apex end portion positioned on the axis of said collector generally aligned with said downstream end of said collector.

9. A muffler and collector as set forth in claim 6 wherein the portion of said nested exhaust tubes contained within said outer casing are perforated.

10. A muffler and collector as set forth in claim 6 wherein said nested exhaust tubes contained within said outer casing are straight.

11. A muffler and collector as set forth in claim 6 wherein each of said plurality of nested exhaust tubes has a circular cross-sectional configuration.

12. The muffler and collector as set forth in claim 6 wherein said outer casing has a cylindrical cross-sectional configuration.

13. The muffler and collector as set forth in claim 6 wherein said tubes contained within said outer casing are twisted in a helical array.

14. The muffler and collector as set forth in claim 11 wherein each of said tubes has a circular cross-sectional configuration.

15. The muffler and collector as set forth in claim 6 wherein said collector wall is perforated.

16. The muffler and collector as set forth in claim 6 wherein said downstream ends of said exhaust tubes are disposed at least about said downstream ends so as to be slightly convergent in the direction of downstream flow with the respective axes of said tube downstream ends being disposed at a slight axial angulation relative to one another as said tubes are received in sealing engagement by the upstream end of said collector.

17. The muffler and collector as set forth in claim 16 wherein said axial angulation is preferably on the order of about a 7° included angle between the respective axes of said tube downstream ends and about a 3.5 angle of said the respective axes of said tube downstream ends relative to the longitudinal axis of the collector as said tubes converge into the upstream end of said collector.

18. A collector and catalytic converter for use with an internal combustion engine comprising:

a plurality of generally nested exhaust tubes for individually receiving exhaust gases from separate associated engine exhaust ports and each having an upstream end adapted to receive the exhaust gases from the associated exhaust port, and a downstream end;

a collector having a generally frustoconically shaped wall and having an open upstream end positioned downstream from said downstream ends of said exhaust tubes to receive exhaust gases directly therefrom, said collector also having an open downstream end and being oriented with its generally frustoconical wall shape convergent in the downstream direction between said collector ends;

means for sealingly engaging the downstream ends of said exhaust tubes with the upstream end of said collector;

at least one catalytic exhaust converter means positioned and arranged within a corresponding exhaust tube at a location upstream and proximal to the upstream end of said collector to thereby provide a separate and distinct catalytic converter within each of said tubes.

19. The collector and catalytic converter as set forth in claim 18 which also comprises:

a cone shaped stem piece oriented with its longitudinal axis substantially parallel to the axis of said outer collector and located coaxially and internally of said collector, said stem piece having a base portion nested between and extending from said downstream ends of said exhaust tubes, and an apex end portion positioned on the axis of said collector generally aligned with said downstream end of said collector.

20. The collector and catalytic converter as set forth in claim 18 wherein said catalytic carrier and said catalytic exhaust converter means comprise a carrier honeycomb core material containing suitable catalytic material.

21. The collector and catalytic converter as set forth in claim 20 wherein said carrier honeycomb material comprises a laminate comprising a flat outer sheet and a corrugated inner sheet rolled up to provide a cylindrically shaped catalytic core having axially extending exhaust flow passageways formed between said sheets of material.

22. The collector and catalytic converter as set forth in claim 21 wherein the ends of said cylindrical catalytic core provide a generally concave first end and a correspondingly shaped generally convex second end.

23. The muffler and collector as set forth in claim 6 wherein each of said plurality of nested exhaust tubes individually includes a catalytic exhaust converter means to thereby provide separate and distinct catalytic converters within each of said tubes.

24. The muffler, collector and catalytic converter as set forth in claim 23 which also comprises:

a pyramidally shaped stem piece, constructed and arranged from flat, concave, or convex members, oriented with its longitudinal axis substantially parallel to the axis of said outer collector and located coaxially and internally of said collector, said stem piece having a base portion nested between and extending from said downstream ends of said exhaust tubes, and an apex end portion positioned on the axis of said collector generally aligned with said downstream end of said collector.

25. The muffler, collector and catalytic converter as set forth in claim 24 wherein said catalytic carrier and said catalytic exhaust converter means comprise a carrier honeycomb core material containing suitable catalytic material.

26. The muffler, collector and catalytic converter as set forth in claim 25 wherein said carrier honeycomb core material comprises a laminate comprising a flat outer sheet and a corrugated inner sheet rolled up to provide a cylindrically shaped catalytic core having axially extending exhaust flow passageways formed between said sheets of material.

27. The muffler, collector and catalytic converter as set forth in claim 26 wherein the ends of said cylindrical catalytic core provide a generally concave first end and a correspondingly shaped generally convex second end.

28. The combination of structure as set forth in claim 6 wherein sound absorbing material is disposed in an interior casing space defined between the inner surface of said outer casing and the outer surface comprising the combination of said nested exhaust tubes and said collector, as well as defined between the inner surfaces of said upstream and downstream end caps.

29. The combination of structure as set forth in claim 18 wherein sound absorbing material is disposed in an interior casing spaced defined between the inner surface of said outer casing and the outer surface comprising the combination of said nested exhaust tubes and said collector, as well as defined between the inner surfaces of said upstream and downstream end caps.

30. The combination as set forth in claims, 6, 7, 8, 18, 19, 23 or 24 wherein said collector wall has an interior surface defining a smooth cylindrical surface when taken in radial cross-section at any position along generally the entire length of the axis of said collector wall downstream of said tube exit ends.

31. The muffler and collector as set forth in claim 15 wherein said collector is perforated with circular holes of about 0.10 inches in diameter, and spaced apart to provide about 0.20 $in^2$ of holes per 1 $in^2$ of surface area.

* * * * *